US005606399A

United States Patent [19]

Kikui

[11] Patent Number: 5,606,399

[45] Date of Patent: Feb. 25, 1997

[54] DEVICE FOR CORRECTING AN APPLIED VOLTAGE IN AN IMAGE FORMING APPARATUS

[75] Inventor: Shinsuke Kikui, Yokohama, Japan

[73] Assignee: Ricoh Company, Ltd., Tokyo, Japan

[21] Appl. No.: 534,297

[22] Filed: Sep. 27, 1995

[30] Foreign Application Priority Data

Sep. 28, 1994 [JP] Japan ..... 6-232600

[51] Int. Cl.[6] ..... G03G 15/02

[52] U.S. Cl. ..... 399/168; 399/9; 399/44

[58] Field of Search ..... 355/208, 216, 355/219, 246

[56] References Cited

U.S. PATENT DOCUMENTS

| | | | |
|---|---|---|---|
| 5,200,780 | 4/1993 | Koichi | 355/208 |
| 5,307,118 | 4/1994 | Morita | 355/208 |
| 5,365,318 | 11/1994 | Hiraoka et al. | 355/246 |
| 5,434,651 | 7/1995 | Aizawa et al. | 355/219 X |

FOREIGN PATENT DOCUMENTS

| | | |
|---|---|---|
| 2-195366 | 8/1990 | Japan . |
| 4-186381 | 7/1992 | Japan . |
| 4-316064 | 11/1992 | Japan . |
| 5-27557 | 2/1993 | Japan . |
| 6-35302 | 2/1994 | Japan . |

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

A voltage is supplied to a charging member by a voltage supplying device, the charging member contacts a photosensitive body, which is rotating in a predetermined direction, in order to charge its surface, temperature of the charging member is detected by a temperature detector, and the voltage to be supplied by the voltage supplying device is corrected by a voltage correcting device in accordance with the result of detection by the temperature detector. At that time, since the quality of an image is stabilized by correction of a reference supplying voltage in accordance with a target electric potential variable depending on change of temperature of the charging member, the electric potential to be charged to the surface of the photosensitive body has a plurality of target values, a reference value of the voltage to be supplied by the voltage supplying device is set per each target value, and a correction rule for a supplying voltage to be corrected by the voltage correcting device is made different by a correction rule changing device per each reference value for a target value of each electric potential to be charged.

6 Claims, 7 Drawing Sheets

DEVICE FOR CORRECTING AN APPLIED VOLTAGE IN AN IMAGE FORMING APPARATUS

BACKGROUND OF THE INVENTION

1. Field of the Invention

This invention relates to an electrophotographic type image forming apparatus such as a laser printer, a copying machine, a facsimile machine and the like. More particularly, it relates to an image forming apparatus for charging the surface of a photosensitive body by means of physical contact of a charging member to the rotating photosensitive body.

2. Description of the Prior Art

Conventionally, there is known an electrophotographic type image forming apparatus as represented, for example, by a copying machine, in which an image (or picture) is formed through a sequence of processes which will be described hereinafter.

The surface of a drum-like or belt-like photosensitive body is uniformly charged by a charger and is then exposed by an exposure device so that an electrostatic latent image is formed thereon. Subsequently, a toner adheres to the latent image on the surface of the photosensitive body by a developing roller disposed in a developing device so that the latent image is visualized. The image-visualized toner is then transferred to the surface of a transfer paper supplied from a paper supplying portion or unit, by a transfer device. The toner transferred to the surface of the transfer paper is then fixed by a fixing device. Thereafter, the transfer paper is discharged. Finally, toner remaining, if any, on the surface of the photosensitive body is removed by a cleaning device.

An image forming apparatus of this type employs a corona discharge system as a means for uniformly charging the surface of the photosensitive body. According to this corona discharge system, the surface of a photosensitive body is charged by ionizing a discharging space.

However, in the corona discharge system, when the surface of the photosensitive body is charged, a large amount of ozone is produced. The ozone has the characteristic that when a minus discharge is made, much more ozone is produced.

Recently, an organic photosensitive body for the use of a minus discharge is widely employed as a photosensitive body. Also, the environmental standard for generation of various kinds of gases including the ozone gas became severer. Thus, a countermeasure is keenly demanded. The corona discharge system is further encountered with the problem that nitrogen compounds (NOx), etc., which are by-produced by ozone, are attracted to the surface of the photosensitive body to cause an abnormal image.

In view of the above, there is developed a contact-to-charge type image forming apparatus as a substitute of the corona discharge system. This new type of an image forming apparatus employs a charging member such as a charging roller to be contacted with the surface of the photosensitive body. According to this contact-to-charge system, the charging roller supplied with voltage is brought into contact with the surface of the photosensitive body. The surface of the photosensitive body is uniformly charged by electric discharge through gaps which, in the strict sense of the word, exist between the charging roller and the photosensitive body. Therefore, in the new system, the voltage to be supplied to the surface of the photosensitive body can be lowered compared with that of the corona discharge system. Thus, the contact-to-charge system has the advantage that the amount of ozone to be produced is radically reduced.

However, the contact-to-charge system also has the shortcomings that a required electric potential to be charged is difficult to be maintained at a certain level and a non-uniform charging occasionally occurs. The reason is that when the circumstance of use is changed, electrical characteristics of the charging roller, such as a value of resistance and a dielectric constant, are changed by that.

As means for preventing the non-uniform charging which is caused, as mentioned, by the change of circumstance of use, the following techniques are known.

In an official gazette of Japanese Laid-Open Patent Application No. Hei 4-186381, there is disclosed a technique for detecting the temperature of a charging roller using a sensor and changing the voltage to be supplied to the charging roller in accordance with the detected temperature. For example, in a case that the charging roller is used under a high-temperature circumstance, an alternating current (AC) is supplied to the charging roller so that there can be obtained a peak inter-voltage as large as more than two times the voltage of the starting time when a direct current (DC) is supplied to the charging roller. On the other hand, in a case that the charging roller is used under a low temperature circumstance, a component of an alternating current to be supplied to the charging roller is increased in accordance with the temperature detected by the sensor (see FIG. 3 of the official gazette).

Also, there is disclosed a similar technique in an official gazette of Japanese Laid-Open Patent Application No. Hei 4-316064, in which the temperature of a charging roller is measured by temperature measuring means so that the alternating current voltage to be supplied to the charging roller can be changed based on the measured temperature. According to the technique disclosed in this official gazette, an alternating current voltage preliminarily combined with a direct current voltage is supplied to the charging roller. It is programmed such that a value of resistance and a dielectric constant of the charging roller are found based on information obtained by the temperature measuring means and the alternating current voltage is varied based on a preliminarily obtained test data.

However, the techniques disclosed in the official gazettes of Japanese Laid-Open Patent Application Nos. Hei 4-186381 and Hei 4-316064 have the following problems. When an alternating current voltage is supplied to the charging roller, a vibration sound is generated from the charging roller. On the other hand, when a direct current voltage is supplied to the charging roller in accordance with the change of temperature of the circumstance, the relations between the supplying voltages by temperatures of circumstance and the surface electric potential (charged electric potential) are changed in inclination and position as indicated by H, H' and H" in the graph of FIG. 7.

In another official gazette of Japanese Laid-Open Patent Application No. Hei 6-35302, there is disclosed a technique for controlling the voltage to be supplied to a charging roller in accordance with a layer thickness of a photosensitive body and circumstance moisture. For example, when the layer thickness of the photosensitive body is reduced due to the increased number of times for forming an image thereon, a voltage/current characteristic corresponding to the capacity with respect to the thickness of the photosensitive body at that time is detected and a corrected optimum supplying voltage is supplied to the charging roller based on the detection. That is, as the layer thickness is reduced, an amount of detected current is increased when a constant voltage is supplied to the non-image forming portion. A voltage reducing correction is applied to the voltage value to be supplied to the non-image forming portion in accordance with the increased amount, so that the charging roller is prevented from being overly charged. Also, when the value of resistance is increased due to fluctuation of the circumstance moisture in the layer of resistance on the charging roller, the amount of detected current is reduced, thus obviating shortage of charging which would otherwise require a voltage increasing correction applied to the voltage value to be supplied to the non-image forming portion.

Such a technique for correcting the supplying voltage to the charging roller in accordance with the layer thickness of the photosensitive body is also disclosed in the official gazette of the Japanese Laid-Open Patent Application No. Hei 5-27557. According to the technique disclosed in this official gazette, any diminution of the layer caused by the increased number of copies is detected by a copy counter and the voltage to be supplied to the charge roller is lowered in accordance with the diminution of the layer, thereby maintaining a constant surface electric potential of the photosensitive body.

However, when a charging roller is used as a charging member, there arises a problem that because the charging ability is varied depending on conditions of the circumstance, any change in surface potential (charging potential) with respect to the thickness of the photosensitive layer on the photosensitive body is different depending on temperature of the charging roller (FIG. 8) and a constant charging potential maintained by a uniform correction.

On the other hand, of all the surface of the photosensitive body, there is a portion corresponding to an area appeared between a first transfer paper and a second transfer paper in a circumferential direction of the photosensitive body, i.e., a no-image forming area (this area is not always fixed or constant with respect to the circumferential direction of the photosensitive body), which portion or area is not contacted with the transfer paper and therefore, no image is formed on that portion or area.

In a copying machine of a recent year, therefore, there is employed a technique for controlling an amount of toner to actually adhere to a transfer paper by detecting an amount (concentration) of toner temporarily attracted to the no-image forming area.

In such an image forming apparatus, referred to as a two-component type copying machine, when an image forming process for a predetermined number of transfer papers is finished, the surface of the photosensitive body is caused to a predetermined voltage by a charging roller and then exposed by an exposure device in order to form a concentration-control pattern in the no-image forming area. Then, a visible image is formed by a developing device. An amount of toner attracted to the no-image forming area is detected by a photo sensor or the like. Based on the result of detection, the supply of toner from a toner supplying device to the developing device is controlled to a preset value.

At that time, the surface electric potential of the no-image forming area is different from that of the image forming portion or area. As a consequence, a plurality of electric potentials (target values) are set with respect to a single photosensitive body.

Incidentally, among the above-mentioned official gazettes, FIG. 10 of the official gazette of the Japanese Laid-Open Patent Application No. Hei 6-35302 discloses one example of such a technique for correcting a supplying voltage taking into consideration a reference value with respect to a plurality of target values.

According to the teaching of the correcting method disclosed in the above-mentioned official gazette, an amount of correction with respect to a reference supplying voltage is equal (constant) as apparent only from the fact that a side line in a graph of FIG. 10 is moved in a parallel relation. This is apparently based on an idea that when the thickness of the layer on the photosensitive body is reduced, the voltage at the start of discharge is also reduced or lowered, and therefore electric charge required is increased.

For example, presume that the reference thickness of layer is represented by a and that there are two different target electric potentials A and B. A correction is made in accordance with a correction rule that when the current thickness of the layer is varied to b at the time of the target electric potential A, a reference supplying voltage corresponding to the target electric potential A is added with $\alpha$. Similarly, a correction is also made in accordance with a correction rule that when the current thickness of the layer is varied to b at the time of the target electric potential B, a reference supplying voltage corresponding to the target electric potential B is added with $\alpha$. That is, the correction value is always "$+\alpha$" whether the target electric potential is A or B.

Also, a correction necessitated by temperature change is made also based on a simple idea, for example, that if the temperature of the charging roller is low, resistance is large and the surface electric potential of the charging roller is decreased. As a consequence, it is customary to think that an amount of correction with respect to the reference supplying voltage is equal irrespective of the target electric potential.

For example, presume that the reference temperature is represented by a and that there are different electric potentials A and B. A correction is made in accordance with a correction rule that when the current temperature is varied to b at the time of the target electric potential A, a reference supplying voltage corresponding to the target electric potential A is added with $\alpha$. Similarly, a correction is also made in accordance with a correction rule that when the current temperature is varied to b at the time of the target electric potential B, a reference supplying voltage corresponding to the target electric potential B is added with $\alpha$. That is, the correction value is always "$+\alpha$" whether the target electric potential is A or B.

However, when such a uniform correction is made, there is encountered a problem that controllability of electric potential with respect to one of the target values is remarkably reduced. As a consequence, an uneven electric potential occurs in the no-image forming area. The results are that the sensor makes a wrong detection and an incorrect amount of toner is supplied, thus causing an unstable image quality.

SUMMARY OF THE INVENTION

It is, therefore, a first object of the present invention to provide an image forming apparatus, in which a correction of a reference supplying voltage can be made in accordance with a target electric potential variable in accordance with a temperature change of a charging member and a stable quality of an image can be realized.

It is a second object of the present invention to provide an image forming apparatus, in which a correction of a reference supplying voltage can be made in accordance with a target electric potential variable in accordance with a change in thickness of the layer on a photosensitive body and a stable quality of an image can be realized.

It is a third object of the present invention to provide an image forming apparatus, in which a correction of a reference supplying voltage can be made in accordance with a target electric potential variable in accordance with a temperature change of a charging member and a change in thickness of the layer on a photosensitive member, a strictly accurate correction can be made in such a manner as to meet change of circumstance, a constant electric potential can always be maintained, and a stable quality of an image can be realized.

It is a fourth object of the present invention to provide an image forming apparatus, in which when a voltage is supplied to a photosensitive body such that different electric potentials are provided to an image forming area and a no-image forming area formed on the single photosensitive body, a correction of a reference supplying voltage can be made in accordance with a target electric potential variable in accordance with a temperature change of a charging member and a change in thickness of the layer on a photosensitive member, a strictly accurate correction can be made in such a manner as to meet change of circumstance, a constant electric potential can always be maintained in each area, and a stable quality of an image can be realized.

It is a fifth object of the present invention to provide an image forming apparatus, in which a correction rule can adequately be switched from one to another because an applicable correction rule is changed in such a manner as to meet a result of detection achieved by detection means based on a preliminarily obtained test result.

It is a sixth object of the present invention to provide an image forming apparatus, in which an applicable correction rule can be changed with ease and in a simple manner in accordance with an amount of aging change of a photosensitive body by detecting an aging change detector with reference to an integrating rotation time of the photosensitive body.

In order to achieve the above objects, according to one aspect of the present invention, there is provided an image forming apparatus comprising a photosensitive body rotatable in a predetermined direction, a charging member to be contacted with the photosensitive body to charge a surface of the photosensitive body, voltage supply means for supplying a voltage to the charging member, temperature detection means for detecting temperature of the charging member, and voltage correction means for correcting the voltage to be supplied by the voltage supply means in accordance with a result of detection by the temperature detection means, wherein:

an electric potential to be charged to the surface of the photosensitive body has a plurality of target values, a reference value of a voltage to be supplied by the voltage supply means is set per each of the target values, and the image forming apparatus further comprises a correction rule changing means for changing a correction rule for the supplying voltage to be corrected by the voltage correction means per each reference value for the target value of the electric potential to be charged.

From another aspect of the present invention, there is also provided an image forming apparatus comprising a photosensitive body rotatable in a predetermined direction, a charging member to be contacted with the photosensitive body to charge a surface of the photosensitive body, voltage supply means for supplying a voltage to the charging member, aging change detection means for detecting aging change of the photosensitive body, and voltage correction means for correcting the voltage to be supplied by the voltage supply means in accordance with the result of detection by the aging change detection means, wherein:

an electric potential to be charged to the surface of the photosensitive body has a plurality of target values, a reference value of a voltage to be supplied by the voltage supply means is set per each of the target values, and the image forming apparatus further comprises a correction rule changing means for changing a correction rule for the supplying voltage to be corrected by the voltage correction means per each reference value for the target value of the electric potential to be charged.

From a further aspect of the present invention, there is also provided an image forming apparatus comprising a photosensitive body rotatable in a predetermined direction, a charging member to be contacted with the photosensitive body to charge a surface of the photosensitive body, voltage supply means for supplying a voltage to the charging member, temperature detection means for detecting temperature of the charging member, aging change detection means for detecting aging change of the photosensitive body, and voltage correction means for correcting the voltage to be supplied by the voltage supply means in accordance with the result of detection by the aging change detection means, wherein:

an electric potential to be charged to the surface of the photosensitive body has a plurality of target values, a reference value of a voltage to be supplied by the voltage supply means is set per each of the target values, and the image forming apparatus further comprises a correction rule changing means for changing a correction rule for the supplying voltage to be corrected by the voltage correction means per each reference value for the target value of the electric potential to be charged.

According to a still further aspect of the present invention, there is also provided an image forming apparatus comprising a photosensitive body rotatable in a predetermined direction, a charging member to be contacted with the photosensitive body to charge a surface of the photosensitive body such that an image forming area and a non-image forming area are charged with different target electric potentials, respectively, voltage supply means for supplying a voltage to the charging member with a reference value set per each area of the photosensitive body, temperature detection means for detecting temperature of the charging member, aging change detection means for detecting aging change of the photosensitive body, electric potential detection means for detecting the charging electric potential of the non-image forming area of the photosensitive body, toner supply amount control means for controlling an amount of a toner attracted to the photosensitive body based on the result of detection by the electric potential detection means, voltage correction means for correcting the voltage to be supplied by the voltage supply means in accordance with the results of detection by the temperature detection means and aging change detection means, and correction rule changing means for changing a correction rule for the supplying voltage to be corrected by the voltage correction means per each reference value for the target value of the electric potential to be charged.

The correction rule changing means is adapted to change an applicable correction rule to a correction rule which meets the result of detection obtained by the detection means based on a preliminarily obtained test result.

The aging change detection means is adapted to detect an integrating rotation time of the photosensitive body.

According to the present invention, a voltage is supplied to the charging member by voltage supply means, the surface of the photosensitive body is charged by means of contact of the charging member with the photosensitive body which is rotating in a predetermined direction, temperature of the charging member is detected by the temperature detection means, and a supplying voltage to be supplied by the voltage supply means is corrected by the voltage correction means in accordance with the result of detection achieved by the temperature detection means. At that time, the electric potential to be charged to the surface of the photosensitive body has a plurality of target values, a reference value of a voltage to be supplied by the voltage supply means is set for each target value, a correction rule of a charging voltage to be corrected by the voltage correction means is made different by the correction rule change means for each reference value with respect to a target value for each electric potential to be charged.

Also, a voltage is supplied to the charging member by the voltage supply means, the surface of the photosensitive body is charged by means of contact of the charging member with the photosensitive body which is rotating in a predetermined direction, aging change of the photosensitive body is detected by the aging change detection means, and the voltage to be supplied by the voltage supply means is corrected by the voltage correction means in accordance with the result of detection achieved by the aging change detection means. At that time, the electric potential to be charged to the surface of the photosensitive body has a plurality of target values, a reference value of a voltage to be supplied by the voltage supply means is set for each target value, a correction rule of a charging voltage to be corrected by the voltage correction means is made different by the correction rule change means for each reference value with respect to a target value for each electric potential to be charged.

Also, a voltage is supplied to the charging member by the voltage supply means, the surface of the photosensitive body is charged by means of contact of the charging member with the photosensitive body which is rotating in a predetermined direction, aging change of the photosensitive body is detected by the aging change detection means, and the voltage to be supplied by the voltage supply means is corrected by the voltage correction means in accordance with the result of detection achieved by the aging change detection means. At that time, the electric potential to be charged to the surface of the photosensitive body has a plurality of target values, a reference value of a voltage to be supplied by the voltage supply means is set for each target value, a correction rule of a charging voltage to be corrected by the voltage correction means is made different by the correction rule change means for each reference value with respect to a target value for each electric potential to be charged.

By means of contact of the charging member with the voltage supply means for supplying a voltage to the charging member with different reference values which are separately set for the image forming area and the no-image forming area on the photosensitive body and the photosensitive body, which is rotating in a predetermined direction, over the entire width thereof, the surface of the photosensitive body is charged with different target potentials at its image forming area and no-image forming area, temperature of the charging member is detected by the temperature detection means, aging change of the photosensitive body is detected by the aging change detection means, the electric potential to be charged to the no-image forming area is detected by the electric potential detection means, an amount of toner attracted to the photosensitive body is controlled by the toner supplying amount control means based on the result of detection achieved by the electric potential detection means, a voltage to be supplied to the voltage supply means is corrected by the voltage correction means in accordance with the results of detection achieved by the temperature detection means and aging change detection means, and the correction rule of the supplying voltage to be corrected by the voltage correction means is made different by the correction rule change means for each reference value with respect to a target value for each electric potential to be charged.

DETAILED DESCRIPTION OF THE PREFERRED EMBODIMENT

Figure 2:
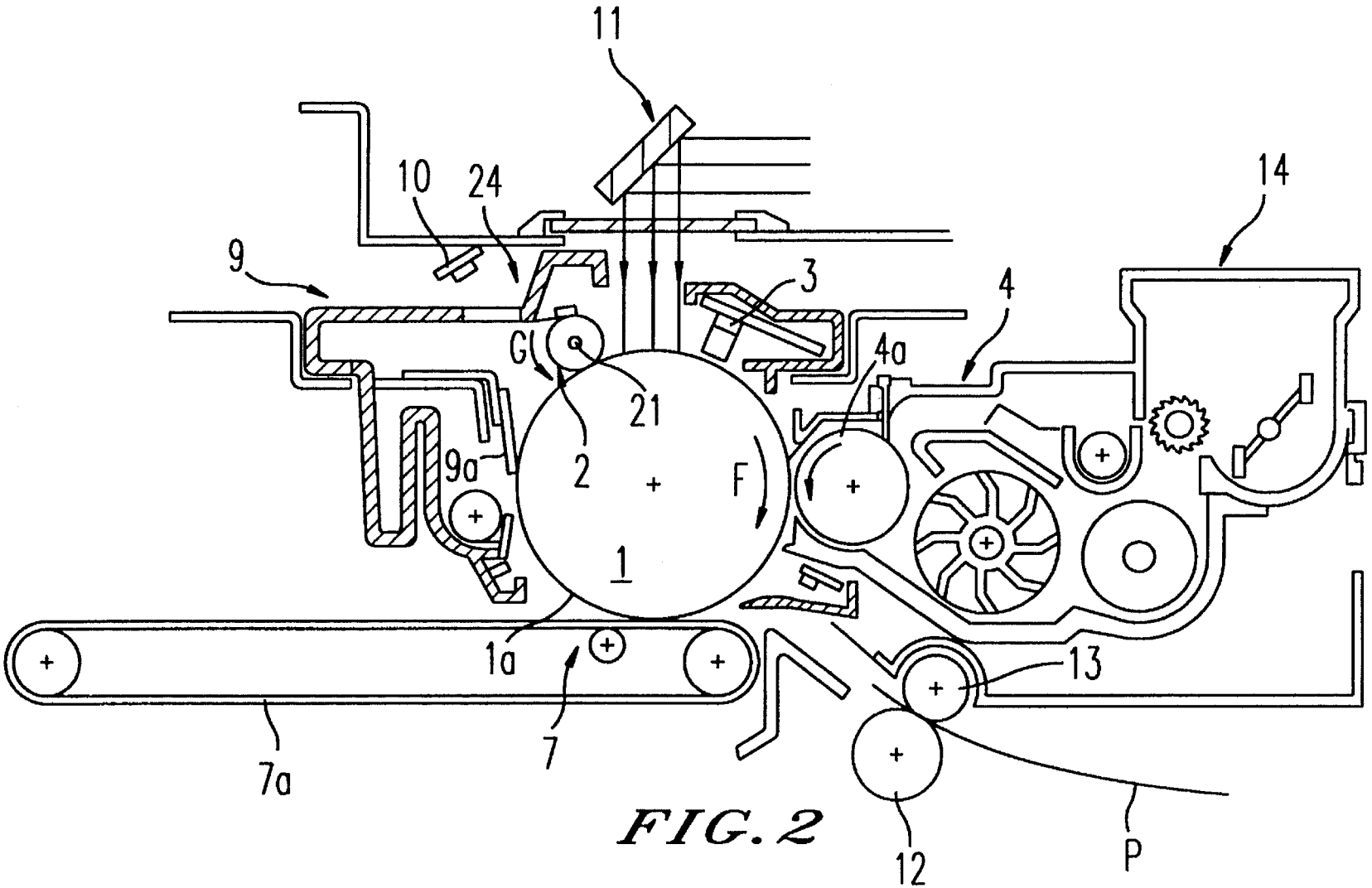
FIG. 2 is a schematic view showing a construction of component parts of a copying machine which are disposed in a neighborhood area of a drum of the copying machine, likewise according to one embodiment of an image forming apparatus of the present invention.

One embodiment of the present invention is applied to a copying machine as an image forming apparatus and the same will be described with reference to the accompanying drawings. FIG. 2 is a schematic view showing a construction of component parts of a copying machine according to the present invention, which component parts are disposed in a neighborhood area of a photosensitive body of the copying machine.

The copying machine shown in FIG. 2 is a contact-to-charge type copying machine which includes a drum-like photosensitive body 1 as a body to be charged, and a charging roller 2 as a charging member, which is to be brought into contact directly with the photosensitive body 1. In the contact-to-charge type copying machine, a preset voltage is supplied to the charging roller 2, so that a surface 1*a* of the photosensitive body 1 is uniformly charged to a predetermined electric potential. When the photosensitive body 1 is rotated in a direction as indicated by an arrow F at a predetermined peripheral speed, the charging roller 2 is also rotated in a direction as indicated by an arrow G (i.e., in an opposite direction to the direction indicated by the arrow F) while contacting the photosensitive body 1.

The photosensitive body 1 is rotationally driven by a driving unit including a drum driving timing belt, a drum driving pulley, a motor for driving them and the like (illustration of any of them is omitted). The charging roller 2 is normally contacted with the surface 1*a* under a predetermined pressure. In addition to the charging roller 2, an eraser 3, a developing device 4, a contact type transfer device 7 having an endless belt 7*a*, a P-sensor 8, a cleaning unit 9, and a quenching lamp 10 are arranged around the photosensitive body 1.

During a usual development process, the charging roller 2 charges the surface 1*a* to a predetermined electric potential (for example, −900 V). The charged surface is exposed to light, which corresponds to an original work to be copied, coming from an exposure device 11 (only a mirror portion is shown) thereby forming an electrostatic latent image thereon. An electrostatic charge of that portion of the electrostatic latent image thus formed, which expands outwardly of the size of a transfer paper P in use is subjected to trimming by the eraser 3. That part of the electrostatic latent image within the size of the transfer paper P is caused to be a visual image (development) by toner supplied from a developing roller (developing sleeve) 4*a* of the developing device 4.

On the other hand, the transfer paper P in a paper feeding cassette, not shown, is fed, one by one, by a paper feeding roller rotating at a predetermined timing. The transfer paper P thus fed is temporarily stopped between a resist roller 12 and a pressure roller 13 rotating in a pressure contact state with the resist roller 12, so that a timing adjustment is made. This timing adjustment is to adjust such that the transfer paper P thus fed and the toner image (visible image) on the surface 1*a* correctly coincide with each other. The adjusted transfer paper P is fed toward a transfer portion having the transfer device 7.

The transfer paper P thus fed to the transfer portion is supplied with a transfer bias by the transfer device 7 and is carried to a fixing device. During the time the transfer paper P is carried to the fixing device, the toner image separated from the photosensitive body 1 is transferred on an upper surface side (in the illustration) of the transfer paper P. The fixing device gradually fixes the toner image on the transfer paper P by heating and then discharge the same into an external discharge tray of the apparatus body.

On the other hand, foreign matter such as toner still remaining when the toner image is separated to the transfer paper P, paper powder of the transfer paper P, and the like adheres to the surface 1*a*. The foreign matter is removed from the surface 1*a* by a cleaning blade 9*a* disposed on a cleaning unit 9. A residual electric potential left on the photosensitive body 1 is removed by the quenching lamp 10 (electricity removing device) so as to be ready for a next charging made by the charging roller 2. Thereafter, the above-mentioned series of working processes from the charging to the discharging are repeated.

Figure 3:
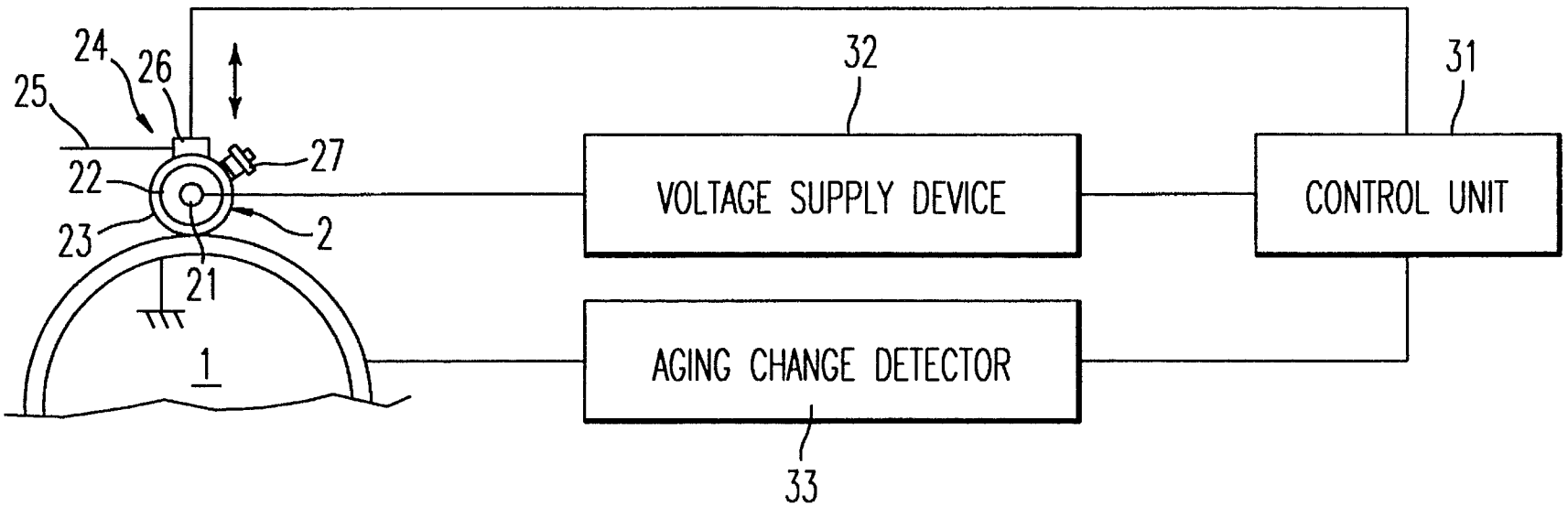
FIG. 3 is an explanatory view showing a main portion and a control system, likewise according to one embodiment of an image forming apparatus of the present invention.

FIG. 3 is a view showing a main portion of FIG. 2 and a control system. The charging roller 2 includes a conductive core 21 made of iron or the like, a resilient layer 22 made of epichlorohydrine rubber attached to an outer periphery of the conductive core 21, and a surface layer 23 formed of a dispersed lumiflon and hydrine rubber applied to the surface of the resilient layer 22.

Figure 1:
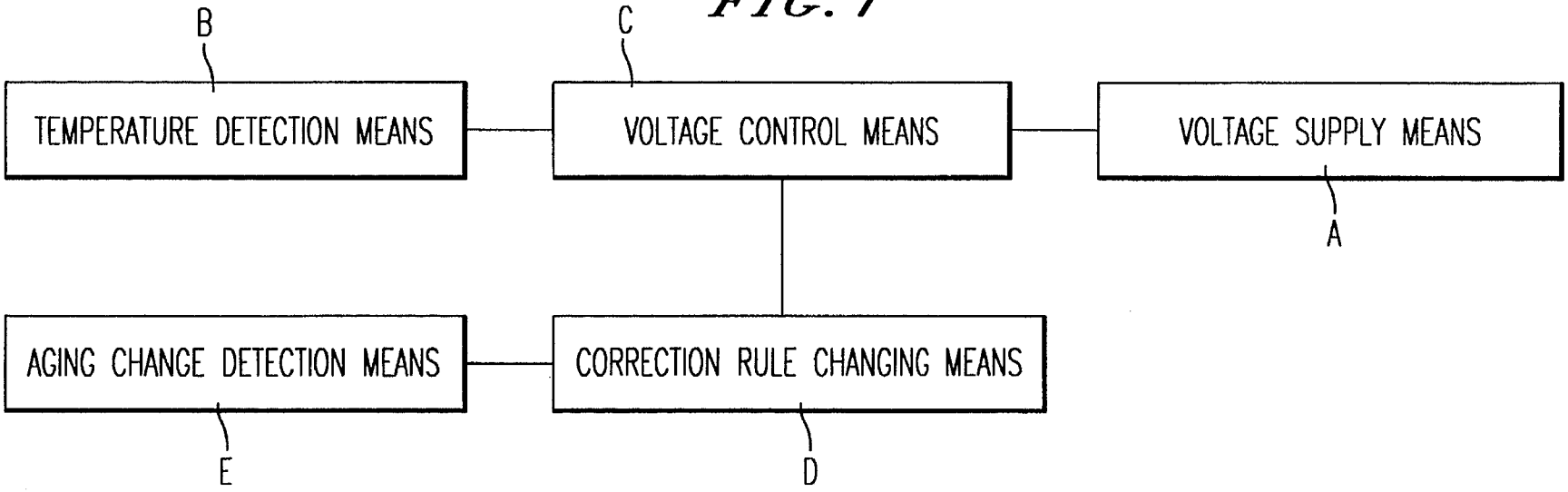
FIG. 1 is a functional block diagram showing a basic construction according to one embodiment of an image forming apparatus of the present invention.

Reference numeral 24 denotes a temperature detecting portion corresponding to temperature detection means B of FIG. 1. The temperature detecting portion 24 comprises a temperature detecting element 26 such as a thermistor firmly secured to a distal end portion of a conductive spring 25. The temperature detecting element 26 is in contact with the surface of the charging roller 2 through a film material, not shown. By this, temperature of the charging roller 2 is detected and the result of detection is output to a control unit 31.

Reference numeral 27 denotes a cleaning member which is located spaced away from the charging roller 2. The cleaning member 27 is adapted to contact and clean the surface of the charging roller 2 by a driver, not shown. The cleaning member 27 contacts the charging roller 2 at a predetermined timing after the completion of the procedure of the present invention as later described.

A general purpose microcomputer is used as the control unit 31 for controlling respective parts of a copying machine. It should be noted that the control unit 31 also functions as a voltage control means C and a correction rule changing means D shown in FIG. 1.

Reference numeral 32 denotes a voltage supply device corresponding to the voltage supply means A of FIG. 1. The voltage supply means 32 supplies a voltage to the conductive core 21 at a predetermined timing. As a consequence, the surface 1*a* is uniformly charged.

Reference numeral 33 denotes an aging change detector corresponding to the aging change detection means E of FIG. 1. The aging change detector 33 detects aging change of the photosensitive body 1. The result of detection is output to the control unit 31. In this embodiment, the aging change of the photosensitive body 1 is converted in terms of integral rotating (turning) time, and the aging change detector 33 counts (detects) the integral rotating time using a timer/counter.

Next, a procedure for controlling the concentration of toner by the P-sensor 8 in the copying machine will be described briefly.

In this copying machine, for example, every time a preset number of copies (image forming process) is finished (in other words, every time a copy is finished), a toner concentration control is performed by the P-sensor 8.

First, the endless belt 7*a* of the transfer device 7 is caused to be spaced apart from the surface 1*a* by a driver, not shown.

Next, the surface 1*a* is charged to a predetermined potential (for example, −600 V) by the charging roller 2. On the charging surface, an electrostatic latent image, which is exposed by light coming from the exposure device 11 reflected by a P-sensor pattern plate (plate on which a concentration controlling pattern is formed) not shown, is formed. The electrostatic latent image is caused to be a visible image by the developing roller 4*a* of the developing device 4, so that a concentration controlling pattern image is formed.

An amount of toner attracted to the concentration controlling pattern image is measured by the P-sensor 8 comprising a photo sensor or the like. Based on this result of measurement, the supplying amount of toner from the toner supplying device 14 to the developing device 4 is controlled to be a predetermined value. Thereafter, the endless belt 7*a* of the transfer device 7 is brought into contact with the surface 1*a* of the photosensitive body 1.

The charging potential (−600 V) of that part (concentration controlling pattern portion) of the surface 1*a* of the photosensitive body 1 where the concentration controlling pattern image is formed, is arranged to be lower than the charging potential (−900 V) of that part (image forming portion) where a toner image is formed during an image forming process. The reason is to prevent the toner from adhering to the ground portion (blank portion) in front of and behind of the concentration controlling pattern portion.

Figure 7:
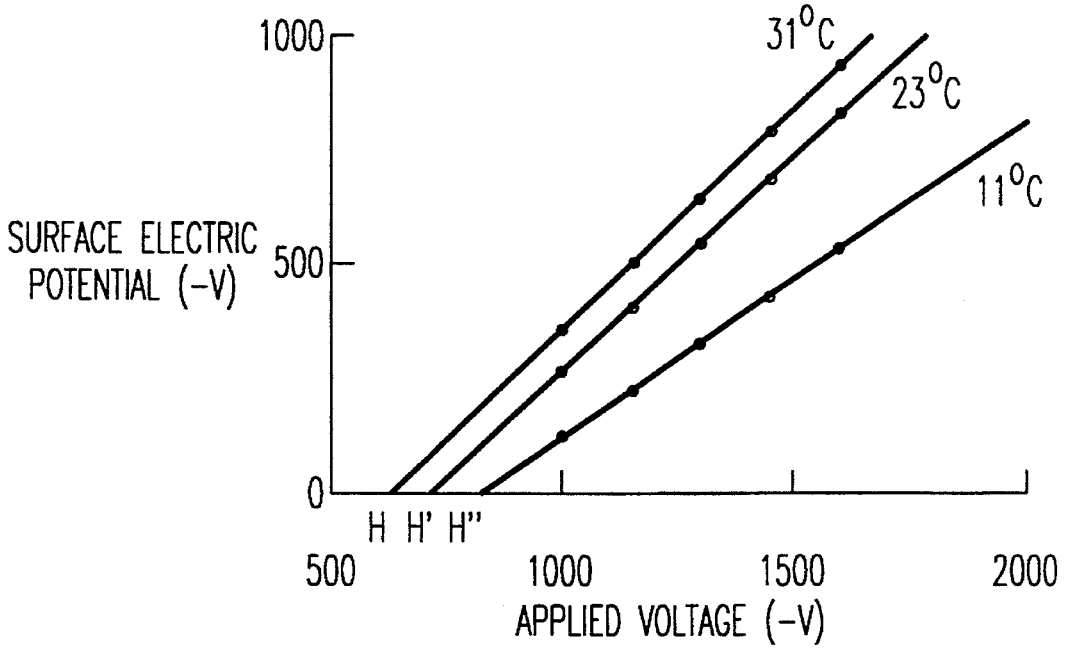
FIG. 7 is a graph showing a relation between a voltage to be supplied to the charging roller and a surface electric potential (charged electric potential) of the photosensitive body by temperatures, likewise according to one embodiment of an image forming apparatus of the present invention.
Figure 8:
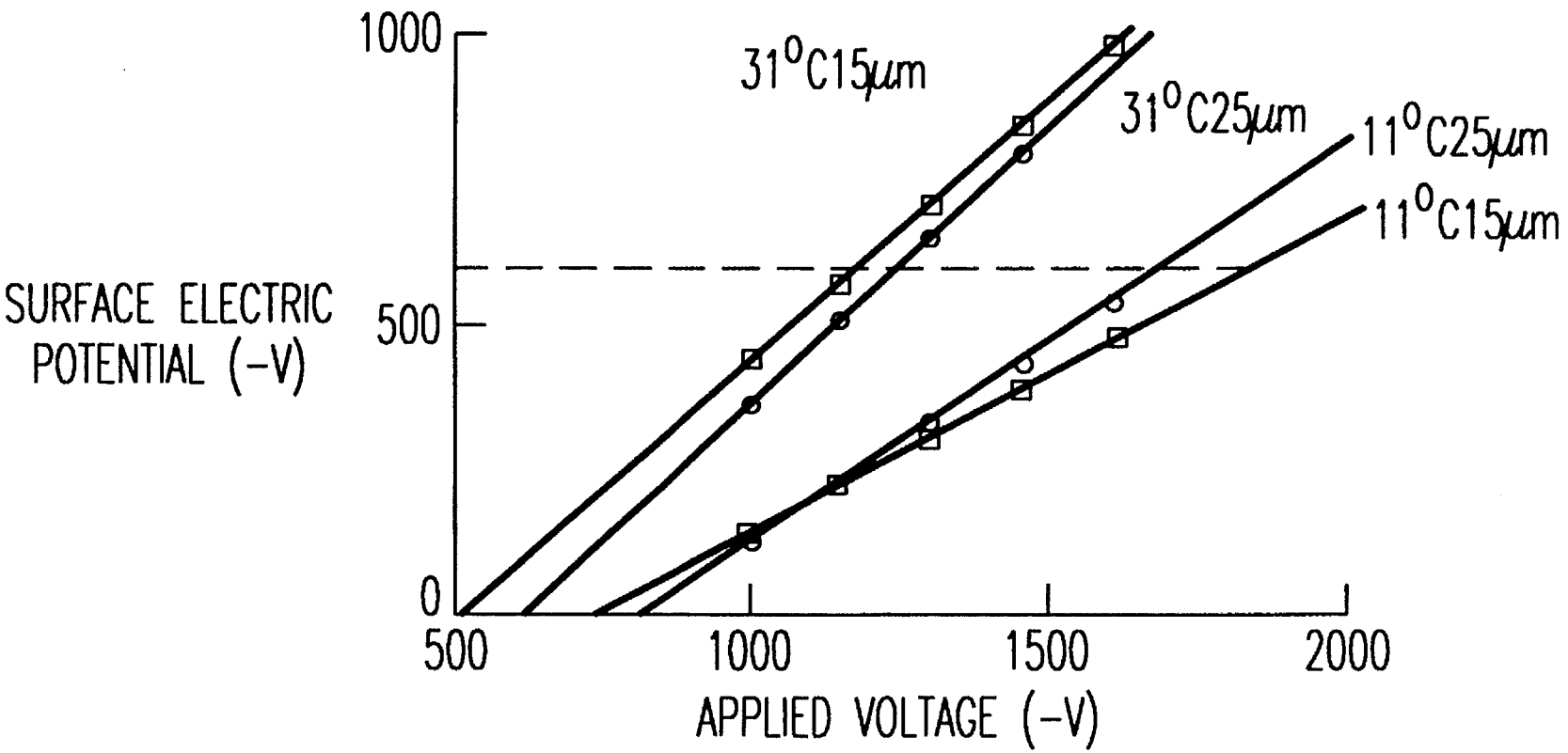
FIG. 8 is a graph showing a relation between a voltage to be supplied to the charging roller by temperatures and a surface electric potential of the photosensitive body by amounts of wear, likewise according to one embodiment of an image forming apparatus of the present invention.

Here, the charging characteristic caused by the charging roller 2 in the copying machine is greatly varied due to a change of temperature of the charging roller 2 (see FIG. 7). With respect to a relation of the charging potential of the photosensitive body 1 to the supplying voltage to the charging roller 2 by temperatures, it is not only the inclination but also the charging voltage to the charging roller 2 at the start of a charging operation of the charging roller 2, which are different depending on temperature (see F. 8).

For example, in a case that the electric potential to be charged is controlled to be −600 V, if the temperature of the charging roller 2 is 11° C., the supplying voltage must be increased, but if the temperature of the charging roller 2 is 31° C., the supplying voltage must be decreased.

Thus, in this embodiment, the correction rule of reference supplying voltages (reference values) corresponding to target values −900 V and −600 V of the charging electric potential of the surface 1*a* of the photosensitive body 1 is made different for each reference value corresponding to each target value depending on temperatures of the charging roller 2 detected by the temperature detecting portion 24.

Also, the correction rule of reference supplying voltages (reference values) corresponding to target values −900 V and −600 V of the charging electric potential of the surface 1*a* of the photosensitive body 1 is made different for each reference value corresponding to each target value depending on aging changes of the layer thickness of the photosensitive body 1 detected by the aging change detecting device 33.

Figure 5A:
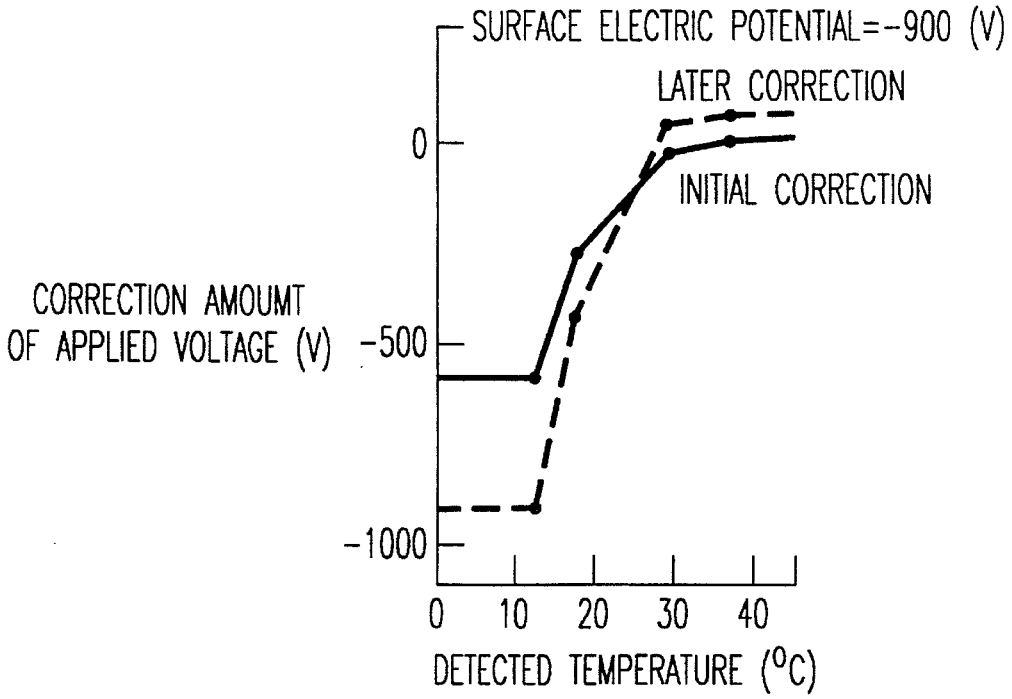
FIG. 5(*a*) is a graph showing a relation between temperature detected by a temperature detecting unit and an amount of correction of a voltage to be supplied to a charging roller when a surface electric potential of a photosensitive body is brought to be −900 V, and FIG. 5(*b*) is a graph showing a relation between a temperature detected by the temperature detecting unit and an amount of correction of a supplying voltage to the charging roller when a surface electric potential of the photosensitive body is brought to be −600 V, likewise according to one embodiment of an image forming apparatus of the present invention.
Figure 5B:
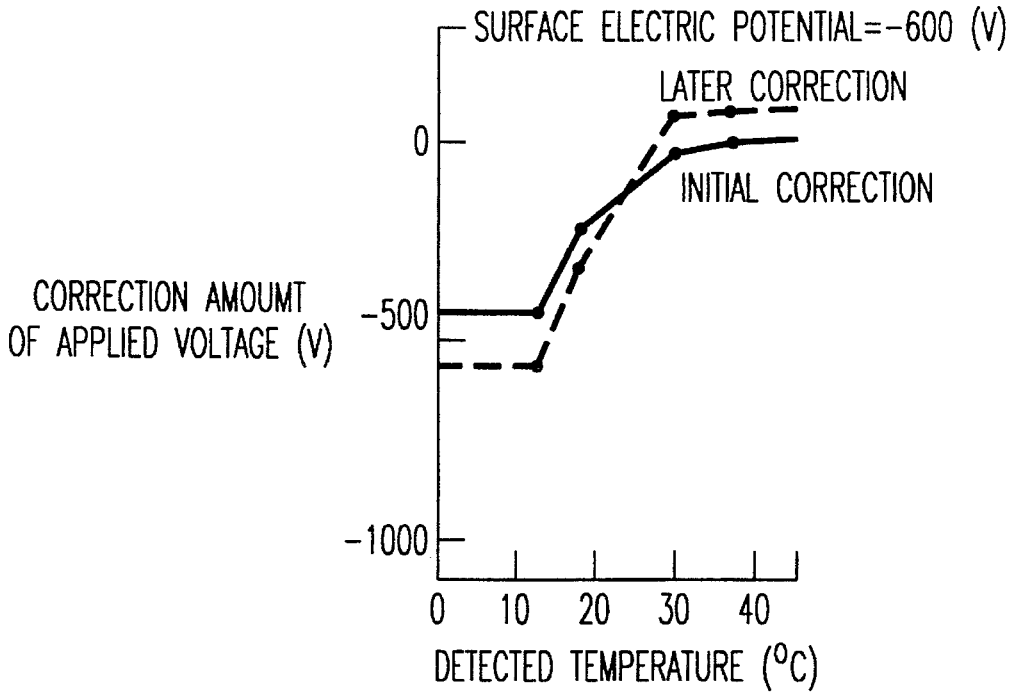
Figure 6:
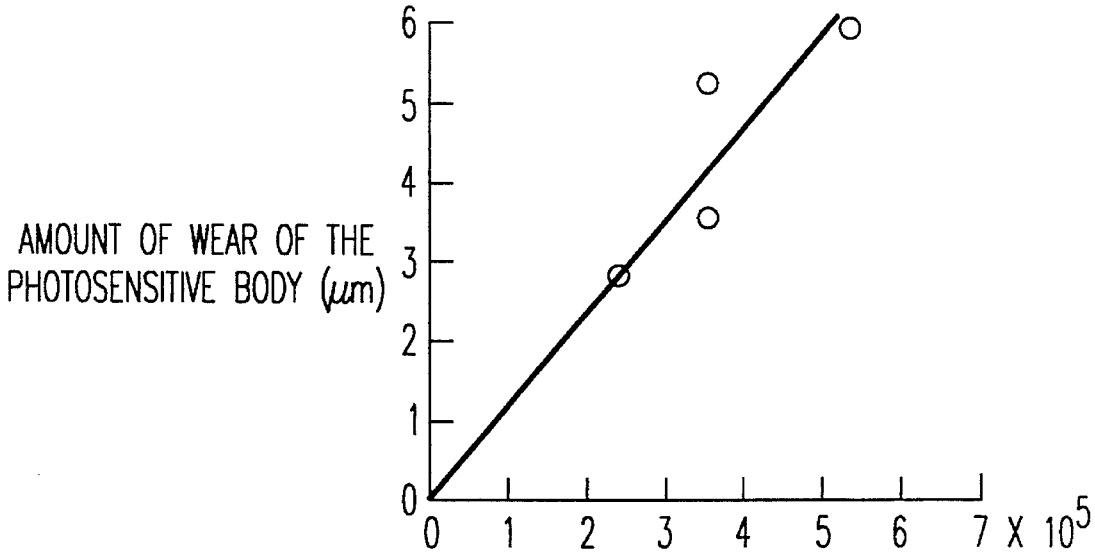
FIG. 6 is a graph showing a relation between an integral number of rotation and an amount of wear of the photosensitive body, likewise according to one embodiment of an image forming apparatus of the present invention.

FIGS. 5(*a*) and 5(*b*) show relations between the temperatures detected by the temperature detecting portion 24 and amounts of correction to the charging roller 2 for each reference value when the target values of the charging electric potential of the photosensitive body 1 are brought to −900 V and −600 V, respectively. Data showing those relations are stored in the ROM of the control unit 31 as correction tables, respectively. FIG. 6 shows a relation between the integrating number of rotation (α integrating time) of the photosensitive body 1 and its amount of wear (shaving amount).

Figure 4:
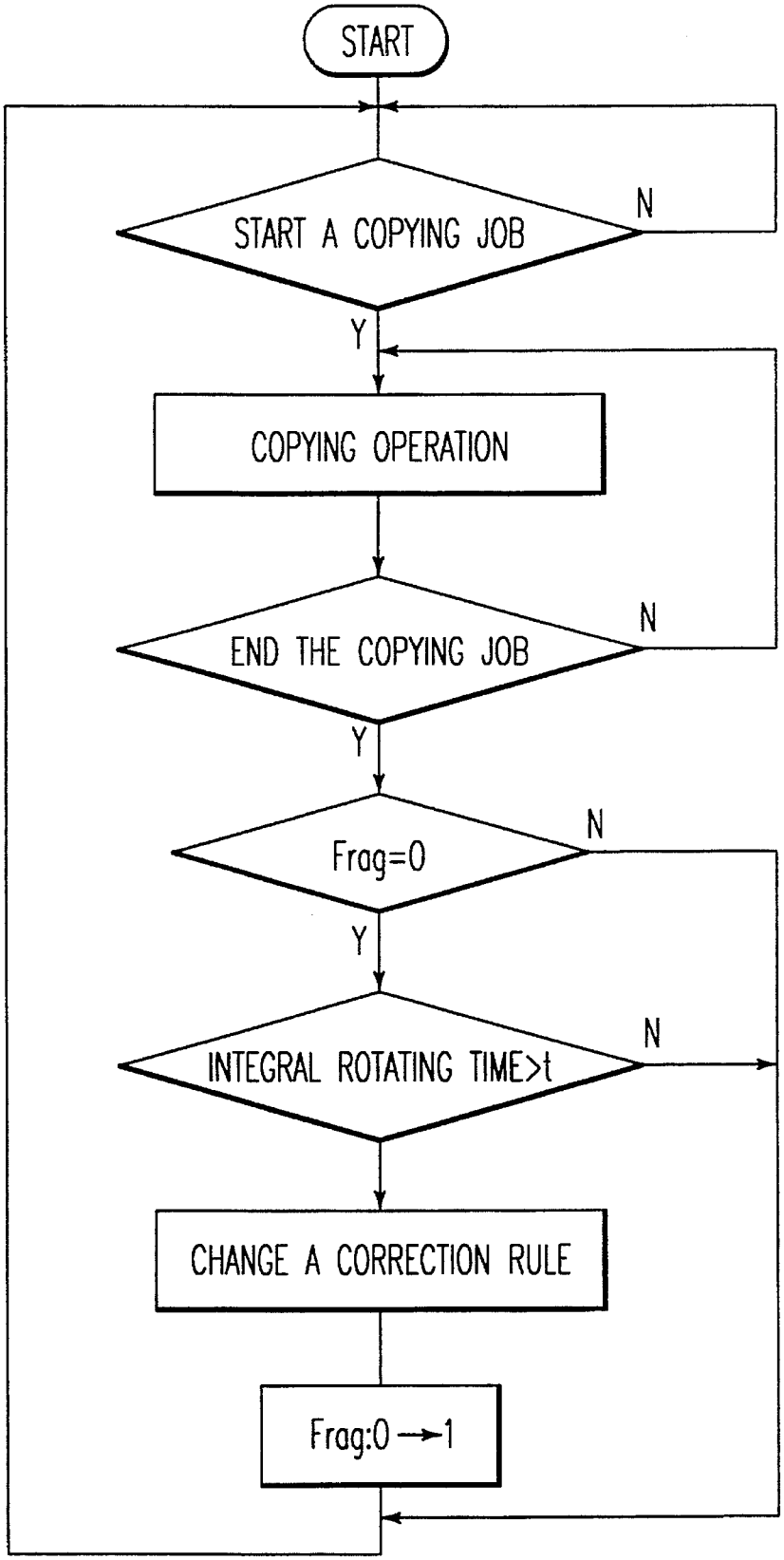
FIG. 4 is a flow chart of one example of a controlling operation performed by a control unit of FIG. 3, likewise according to one embodiment of an image forming apparatus of the present invention.

FIG. 4 is a flow chart showing one example of a controlling operation of the control unit 31.

This routine starts when a main switch, not shown, is turned on. First, it is judged whether or not a copying job has started by determining whether or not a start key, not shown, is depressed. If the judgment result is affirmative, a copying operation for the first sheet of paper is performed.

At that time, reference is made with respect to a correction rule, which is currently set, among two correction rules shown in FIG. 5(*a*). Then, a correction amount of the supplying voltage to the charging roller 2 is obtained from the temperature detected by the temperature detecting portion 24. Further, a voltage obtained by adding the same to the reference voltage is supplied to the charging roller 2 by the voltage supplying device 32. By doing this, the surface 1*a* of the photosensitive body 1 is charged to −900 V.

When the copying operation for the first sheet of paper is finished, it is then judged whether or not the copying job is finished. If it is set that a further copying operation for sheets of paper including the second sheet of paper is required, a copying operation for the required sheets of paper including the second one is performed. When the copying operation of those sheets of paper including the second one is finished, it is judged whether or not Frag=0. This Frag is initially set to zero (0) at the start of the copying machine. Thereafter, even if it becomes Frag=1, it is initialized to Frag=0 every time the photosensitive body 1 is replaced by a new one.

When it is not Frag=0, it is judged again whether or not the copying job has started. Thereafter, this routine is repeated. In case of Frag=0, it is judged whether or not the integrating rotating time of the photosensitive body 1 has reached a preset time t. At that time, it is presumed that the integrating rotating time is always counted by a routine not shown. Also, it is presumed, for example, that the preset time t is 40 hours. When the integrating rotating time has reached the preset time t, the correction rule of the supplying voltage to the charging roller 2 is switched from one to another. That is, the correction rule indicated by a solid line of FIG. 5(*a*) is switched to another correction rule indicated by a broken line.

Then, it is brought to Frag=1. Thereafter, the correction rule with respect to the photosensitive body 1 is not switched until the photosensitive body 1 is replaced by a new one. Then, the process returns to the previous step where it is judged whether or not the copying job has started and the same procedure as mentioned above is repeated thereafter. Although not shown, a toner concentration controlling is also performed by the P-sensor 8 every time a predetermined number of sheets of paper are copied.

At that time, an amount of correction of a supplying voltage to the charging roller 2 is obtained from the temperature detected by the temperature detecting portion 24 with reference to one of the correction rules shown in FIG. 5(*b*), namely, with reference to the correction rule indicated by a solid line until the integrating rotation time of the photosensitive body reaches the set time t and the correction rule indicated by a broken line after the integrating rotation time of the photosensitive body reaches the preset time t. A voltage obtained by adding the amount of correction thus obtained to the reference voltage is supplied to the charging roller 2 by the voltage supplying device 32. The surface 1*a* of the photosensitive body 1 is charged to −600 V.

In this way, according to the copying machine of this embodiment, different correction rules of the supplying voltage to be supplied to the charging roller 2 are prepared in such a manner as to correspond to the plural target values of the electric potential to be charged to the surface 1*a* of the photosensitive body 1 by the control unit 31. Also, different correction rules of the voltage to be supplied by the voltage correction means C are prepared in such a manner as to correspond to the amount of aging change detected by the aging change detecting device 33.

Accordingly, the surface electric potential of the photosensitive body 1 can always be maintained to a predetermined value for each target value irrespective, for example, of a temperature in the apparatus body, circumstance of use such as use conditions, etc., or aging change of the photosensitive body 1. Consequently, a stable image quality can be obtained. Also, since the aging change detecting means 33 detects the integrating rotation time of the photosensitive body 1, change of the correction rule in accordance with the amount of aging change of the photosensitive body 1 can be performed in a simple manner.

It should be noted that the surface electric potential has a plurality of target values not only in such a case where the electric potential to be charged to the image forming area of the photosensitive body 1 is changed to the electric potential to be charged to the concentration controlling pattern portion, but also in such a case where an image density is adjusted, for example, a copy density is adjusted on the darker side or lighter side with respect to an original text. Therefore, it is possible to employ the arrangement for switching the correction rule from one to another for changing the electric potential to be charged to an image forming area for the purpose of adjusting the image density as mentioned.

In the foregoing description, an image forming apparatus of the present invention is applied to a copying machine. However, it should be noted that the present invention can, of course, be applicable to such an optical printer as a laser printer, an LED printer, a liquid-crystal printer, or the like, and another electrophotographic type image forming apparatus such as a facsimile machine. The photosensitive body is not necessarily of the drum system but may be of the belt system.

As described in the foregoing, according to the invention, a correction of the reference voltage to be supplied can be made in accordance with a target electric potential variable in accordance with temperature change of the charging member, and a stable image quality can be obtained.

Further, according to the invention, a correction of the reference voltage to be supplied can be made in accordance with a target electric potential variable in accordance with a change of the thickness of layer on the photosensitive body, and a stable image quality can be obtained.

Further, according to the invention, a correction of the reference voltage to be supplied can be made in accordance with a target electric potential variable in accordance with temperature change of the charging member and change of the thickness of layer on the photosensitive body, a strictly accurate correction can be made in such a manner as to meet change of circumstance, a constant electric potential can always be maintained, and a stable quality of an image can be obtained.

Further, according to the invention, when a voltage is supplied to a photosensitive body such that different electric potentials are provided to an image forming area and a no-image forming area formed on the single photosensitive body, a correction of a reference supplying voltage can be made in accordance with a target electric potential variable in accordance with temperature change of a charging member and change in thickness of layer on a photosensitive member, a strictly accurate correction can be made in such a manner as to meet change of circumstance, a constant electric potential can always be maintained in each area, and a stable quality of an image can be obtained.

Further, according to the invention, a correction rule can adequately be switched from one to another because an applicable correction rule is changed in such a manner as to meet a result of detection achieved by detection means based on a preliminarily obtained test result.

Further, according to the invention, an applicable correction rule can be changed with ease and in a simple manner in accordance with an amount of aging change of a photosensitive body by detecting an aging change detector with reference to an integrating rotation time of the photosensitive body.

What is claimed is:

1. An image forming apparatus comprising a photosensitive body rotatable in a predetermined direction, a charging member to be contacted with said photosensitive body to charge a surface of said photosensitive body, voltage supply means for supplying a voltage to said charging member, temperature detection means for detecting temperature of said charging member, and voltage correction means for correcting the voltage to be supplied by said voltage supply means in accordance with a result of detection by said temperature detection means, wherein:

an electric potential to be charged to the surface of said photosensitive body has a plurality of target values, a reference value of a voltage to be supplied by said voltage supply means is set per each of said target values, and said image forming apparatus further comprises a correction rule changing means for changing a correction rule for the supplying voltage to be corrected by said voltage correction means per each reference value for the target value of the electric potential to be charged.

2. An image forming apparatus comprising a photosensitive body rotatable in a predetermined direction, a charging member to be contacted with said photosensitive body to charge a surface of said photosensitive body, voltage supply means for supplying a voltage to said charging member, aging change detection means for detecting aging change of said photosensitive body, and voltage correction means for correcting the voltage to be supplied by said voltage supply means in accordance with a result of detection by said aging change detection means, wherein:

an electric potential to be charged to the surface of said photosensitive body has a plurality of target values, a reference value of a voltage to be supplied by said voltage supply means is set per each of said target values, and said image forming apparatus further comprises a correction rule changing means for changing a correction rule for the supplying voltage to be corrected by said voltage correction means per each reference value for the target value of the electric potential to be charged.

3. An image forming apparatus comprising a photosensitive body rotatable in a predetermined direction, a charging member to be contacted with said photosensitive body to charge a surface of said photosensitive body, voltage supply means for supplying a voltage to said charging member, temperature detection means for detecting temperature of said charging member, first voltage correction means for correcting the voltage to be supplied by said voltage supply means in accordance with a result of detection by said temperature detection means, aging change detection means for detecting aging change of said photosensitive body, and second voltage correction means for correcting the voltage to be supplied by said voltage supply means in accordance with a result of detection by said aging change detection means, wherein:

an electrical potential to be charged to the surface of said photosensitive body has a plurality of target values, a reference value of a voltage to be supplied by said voltage supply means is set per each of said target values, and said image forming apparatus further comprises first correction rule changing means for changing a correction rule for the supplying voltage to be corrected by said first voltage correction means per each reference value for the target value of the electric potential to be charged and second correction rule changing means for changing a correction rule for the supplying voltage to be corrected by said second voltage correction means per each reference value for the target value of the electric potential to be charged.

4. An image forming apparatus comprising a photosensitive body rotatable in a predetermined direction, a charging member to be contacted with said photosensitive body to charge a surface of said photosensitive body such that an image forming area and a non-image forming area are charged with different target electric potentials, respectively, voltage supply means for supplying a voltage to said charging member with a reference value set per each area of said photosensitive body, temperature detection means for detecting temperature of said charging member, aging change detection means for detecting aging change of said photosensitive body, electric potential detection means for detecting the charging electric potential of the non-image forming area of said photosensitive body, toner supply amount control means for controlling an amount of a toner attracted to said photosensitive body based on a result of detection obtained by said electric potential detection means, voltage correction means for correcting the voltage to be supplied by said voltage supply means in accordance with results of detection obtained by said temperature detection means and aging change detection means, and correction rule changing means for changing a correction rule for the supplying voltage to be corrected by said voltage correction means per each reference value for the target value of the electric potential to be charged.

5. An image forming apparatus according to one of claims 1 to 4, wherein said correction rule changing means is adapted to change an applicable correction rule to a correction rule which meets the result of detection obtained by said detection means based on a preliminarily obtained test result.

6. An image forming apparatus according to one of claims 2 to 4, wherein said aging change detection means is adapted to detect an integrating rotation time of said photosensitive body.

* * * * *